US007694710B2

(12) United States Patent
Hong

(10) Patent No.: US 7,694,710 B2
(45) Date of Patent: Apr. 13, 2010

(54) OPTICAL DISK LABELING DEVICE

(76) Inventor: Shu-Chi Hong, 8F, No. 76, Sec. 1, Minquan E. Rd., Taipei City (TW)

( * ) Notice: Subject to any disclaimer, the term of this patent is extended or adjusted under 35 U.S.C. 154(b) by 163 days.

(21) Appl. No.: 12/168,211

(22) Filed: Jul. 7, 2008

(65) Prior Publication Data

US 2010/0000688 A1 Jan. 7, 2010

(51) Int. Cl.
*B31F 5/00* (2006.01)

(52) U.S. Cl. ..... 156/556; 156/60; 156/391; 156/514; 156/538; 156/579; 156/580; 156/DIG. 24; 156/DIG. 37

(58) Field of Classification Search ..... 156/60, 156/391, 514, 538, 556, 579, 580, DIG. 24, 156/DIG. 37
See application file for complete search history.

(56) References Cited

U.S. PATENT DOCUMENTS 5,783,033 A 7/1998 Grossman
5,958,177 A * 9/1999 Claussnitzer ..... 156/391
6,484,777 B1 * 11/2002 Quinteros et al. ..... 156/391
2003/0131942 A1 * 7/2003 Chieh ..... 156/391

FOREIGN PATENT DOCUMENTS

TW M306382 2/2007

* cited by examiner

*Primary Examiner*—Kat Wyrozebski
*Assistant Examiner*—Joshel Rivera
(74) *Attorney, Agent, or Firm*—Frenkel & Associates, PC

(57) ABSTRACT

An improved optical disk labeling device includes a label holding dock containing a holding portion and an optical disk holding dock slidable on the holding portion. The holding portion has downward and upward tracks. The downward and upward tracks have two ends forming a first anchor portion and a second anchor portion that communicate with each other. Through an actuation member the optical disk holding dock can be anchored at a first position to receive a first depressing force so that the actuation member is moved along the downward track to hold the optical disk holding dock at a second position. At the second position the optical disk holding dock can receive a second depressing force so that the actuation member slides along the upward track and allows the optical disk holding dock to return to the first position.

12 Claims, 12 Drawing Sheets

OPTICAL DISK LABELING DEVICE

FIELD OF THE INVENTION

The present invention relates to an optical disk labeling device and particularly to an optical disk labeling device to bond a label on an optical disk.

BACKGROUND OF THE INVENTION

Optical disk is a storage medium to store digital data. As optical disk burners become increasingly popular the chance of using the optical disk to store data also is greater. Whether an optical disk has data stored thereon is difficult to recognize from outside appearance. Hence users generally make marks on the optical disk for recognition. A common approach is making a mark through a mark pen or by bonding a label. However, the oil-based ink of the mark pen tends to damage the optical disk, and adding the label makes the weight of the optical disk unbalanced and could result in damage of the optical disk drive during high speed rotation.

At present most optical disks are labeled by optical disk labeling devices. U.S. Pat. No. 5,783,033 discloses a labeling device which includes a labeling circumferential flange, a rod for holding an optical disk, a piston and a compressed spring. The rod is held on the labeling circumferential flange. The compressed spring is held in the piston beneath the rod. When in use a label has the bonding surface facing upwards to be held flatly on the labeling circumferential flange; the optical disk is held on the rod with the bonding surface facing downwards; then the rod is depressed and sunk partially in the labeling circumferential flange to bond the label to the optical disk. After the depressing force is released, the compressed spring pushes the rod to its original position.

R.O.C. patent No. M306382 also discloses an optical disk labeling device which includes a base tray with a round post located thereon in the center, a label holding dock to hold a label, an optical disk holding dock which has a force applying portion and a loading portion with the force applying portion formed at a diameter smaller than the loading portion such that the loading portion can hold an optical disk thereon, a driving unit having a driving shaft, an actuation means and a compressed spring. The compressed spring is held in the driving shaft which has one end coupling with the optical disk holding dock and another end coupling on the round post so that the optical disk holding dock is movable up and down. The driving shaft has a gear rack at one side. The actuation means has a gear. The gear and the gear rack are engaged. When a depressing force is absent the optical disk holding dock is in a regular condition. When the optical disk holding dock is moved downwards under the force, the driving shaft transfers the force downward to the compressed spring. When the pressure is released, the compressed spring pushes the driving shaft to its original position, and the gear engaged with the gear rack reduces the bouncing speed of the driving shaft so that the optical disk holding dock is moved slowly to the regular position.

While the techniques and devices mentioned above can bond a label onto an optical disk, they consist of a great deal of components and cause higher production costs. Fabrication and assembly are more complex. Hence, production efficiency is lower.

SUMMARY OF THE INVENTION

The primary object of the present invention is to solve the aforesaid disadvantages by reducing elements and simplifying the structure of an optical disk labeling device.

The optical disk labeling device according to the invention aims to bond a label on an optical disk. It includes a label holding dock with a label holding surface formed thereon and an optical disk holding dock with a disk holding surface formed thereon. The label holding dock has a holding portion forming an opening on the label holding surface. The holding portion has two track portions. Each track portion has a downward track and an upward track that have two ends communicating with each other to form a first anchor portion and a second anchor portion. The optical disk holding dock is slidable on the holding portion and coupled therewith through an actuation member. The actuation member has two elastic arms corresponding to the two track portions. The two elastic arms have a sliding portion to form an anchor relationship with the first and second anchor portions to hold the optical disk at a first position and a second position. The optical disk holding dock receives a first depressing force at the first position so that the sliding portion slides on the downward track to the second position to anchor the optical disk holding dock on the second position. The optical disk holding dock on the second position can receive a second depressing force so that the sliding portion slides on the upward track to the first anchor portion to return the optical disk holding dock to the first position. Through the actuation member and the downward and upward tracks that communicate with each other, the optical disk holding dock can receive the forces and slide to the first or second position. As a result, the number of total elements of the invention is fewer and the structure is simpler. Comparing with the conventional techniques, the production cost is lower and production efficiency is higher.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
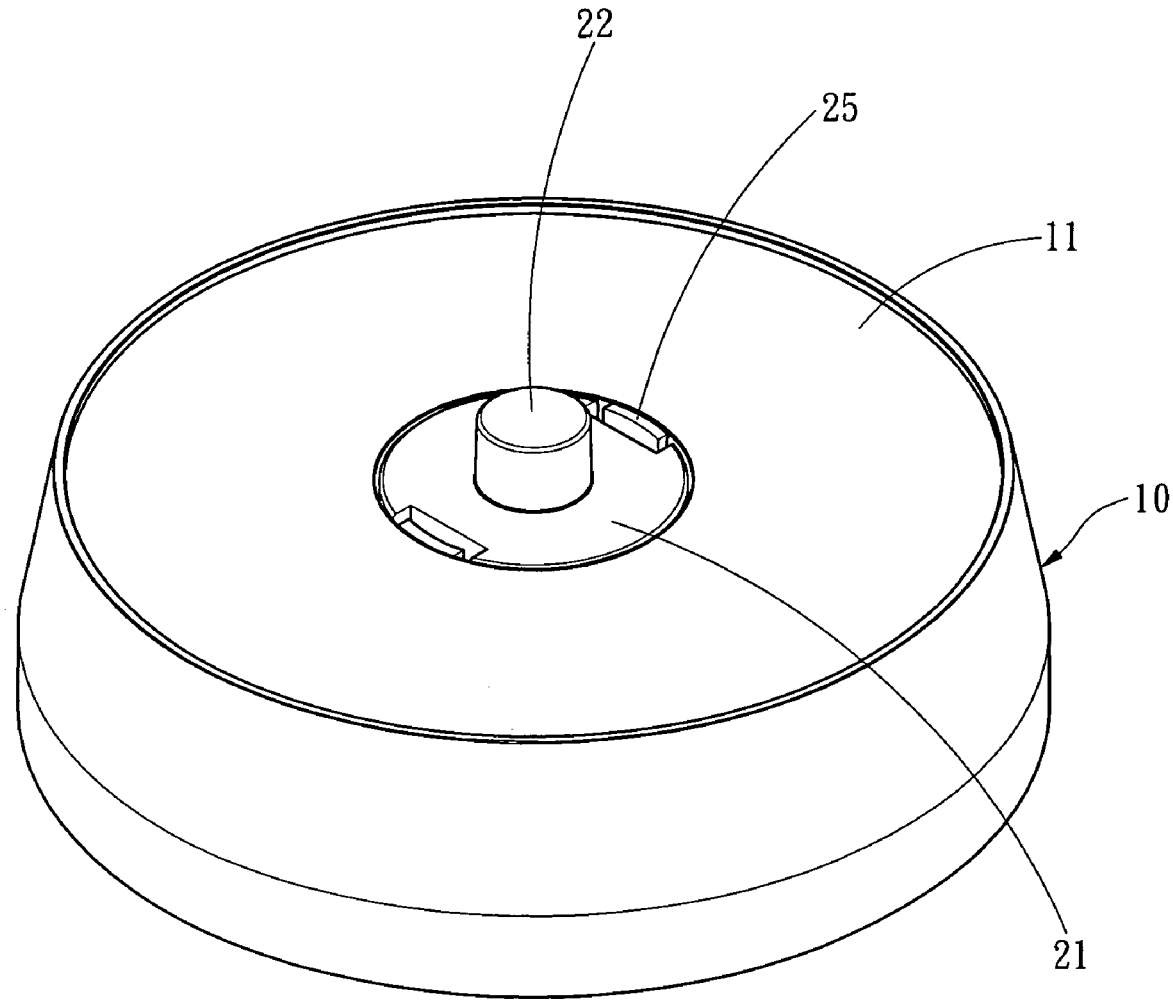
FIG. 1 is a perspective view of the invention.
Figure 2A:
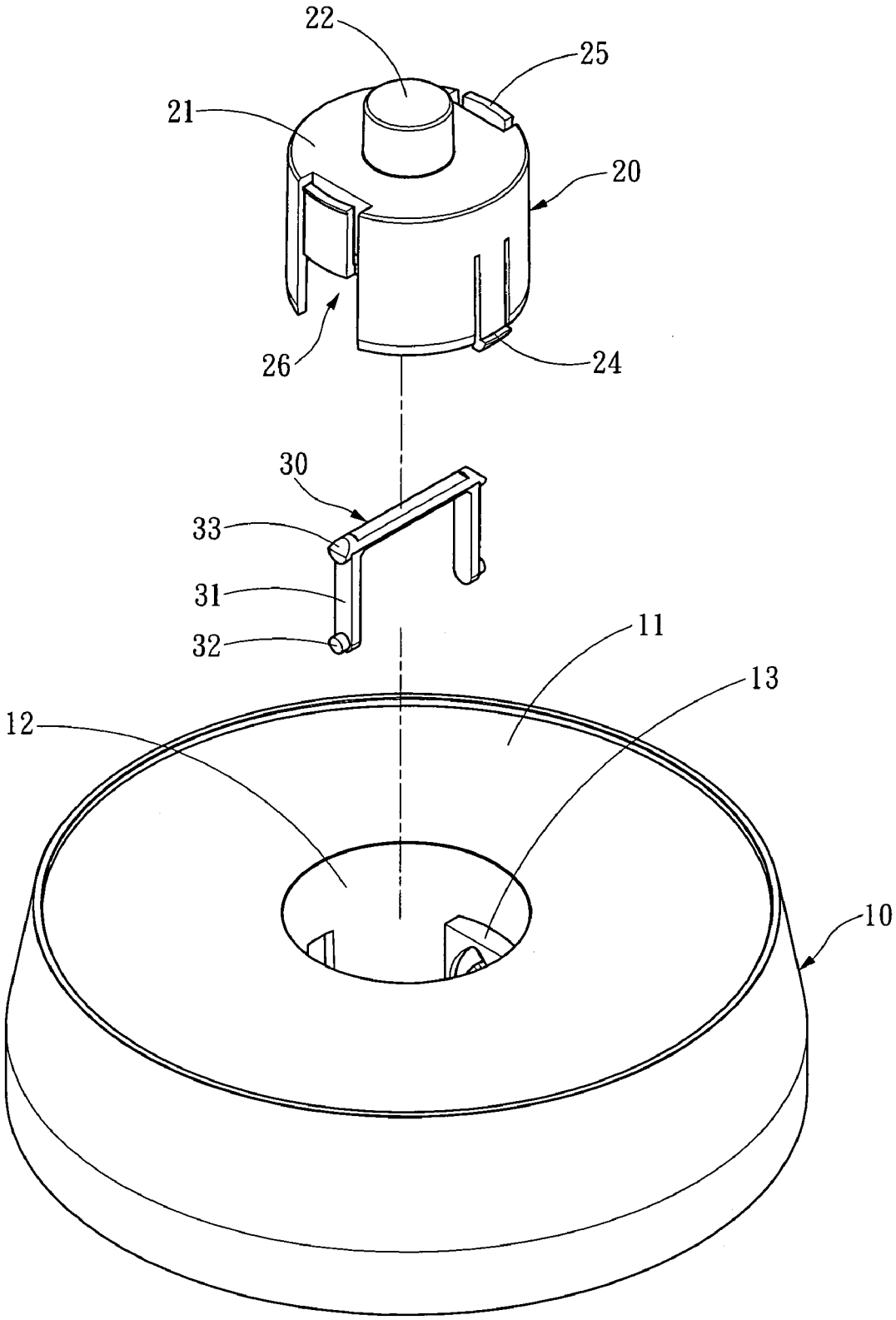
FIGS. 2A and 2B are exploded views of the invention.
Figure 2B:
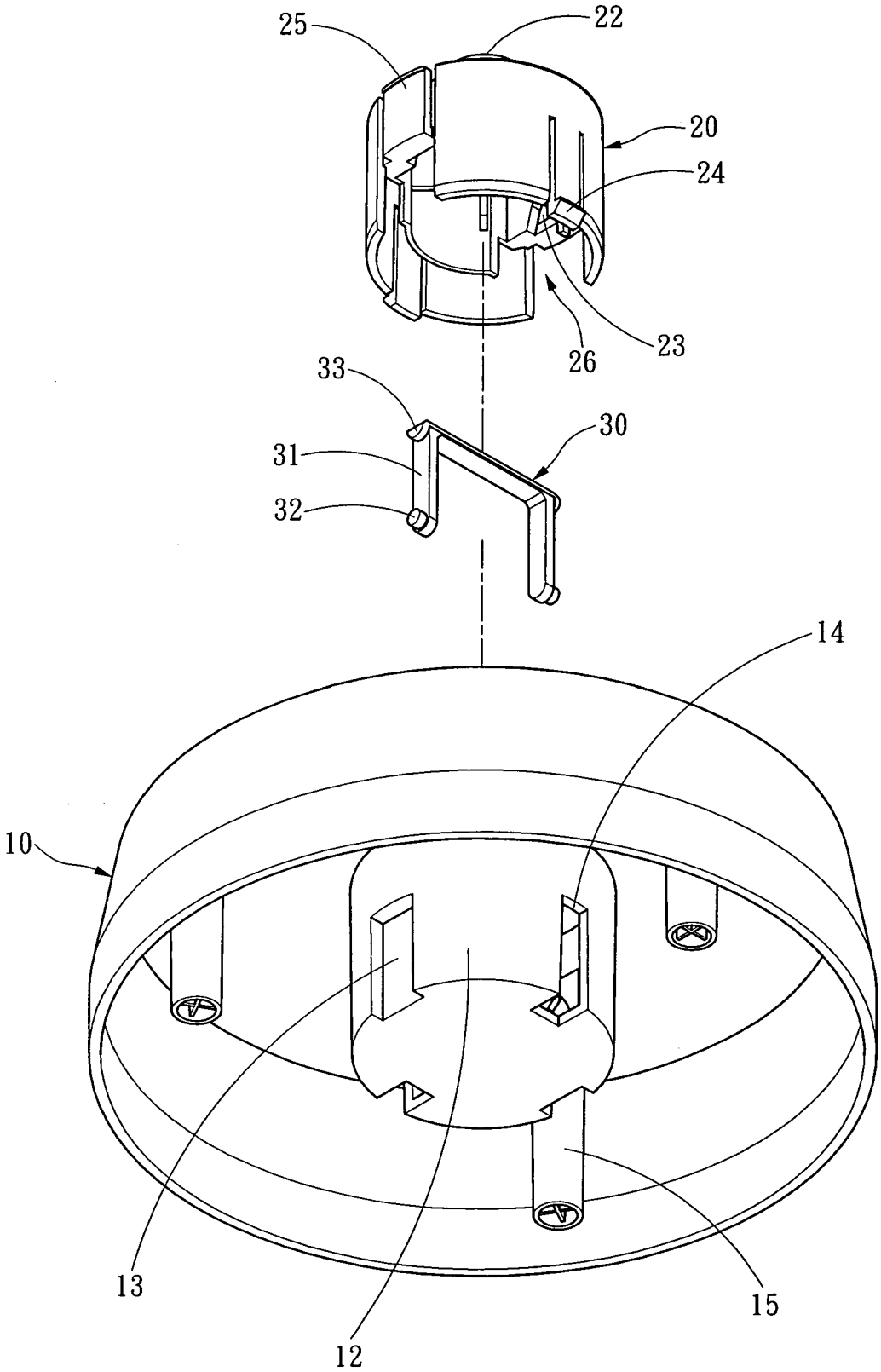
Figure 3:
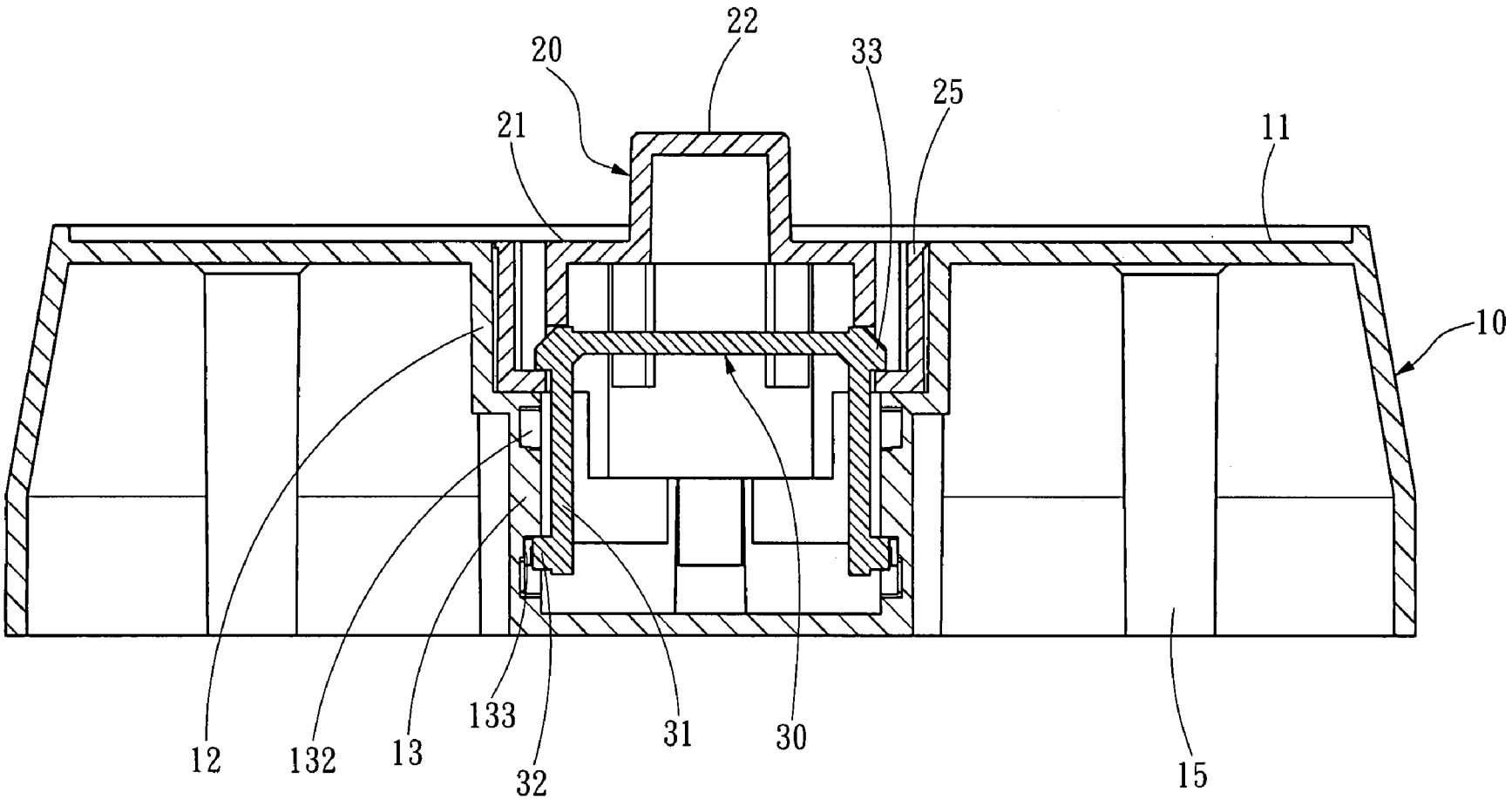
FIG. 3 is a sectional view of the invention.
Figure 4A:
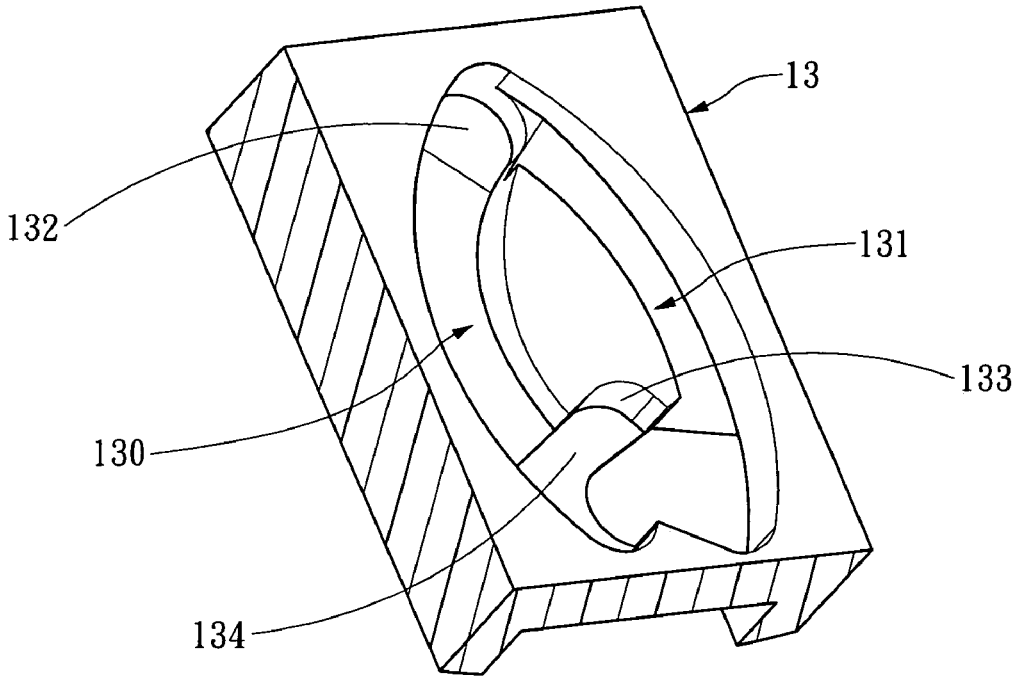
FIGS. 4A and 4B are perspective views of the track portions of the invention.
Figure 4B:
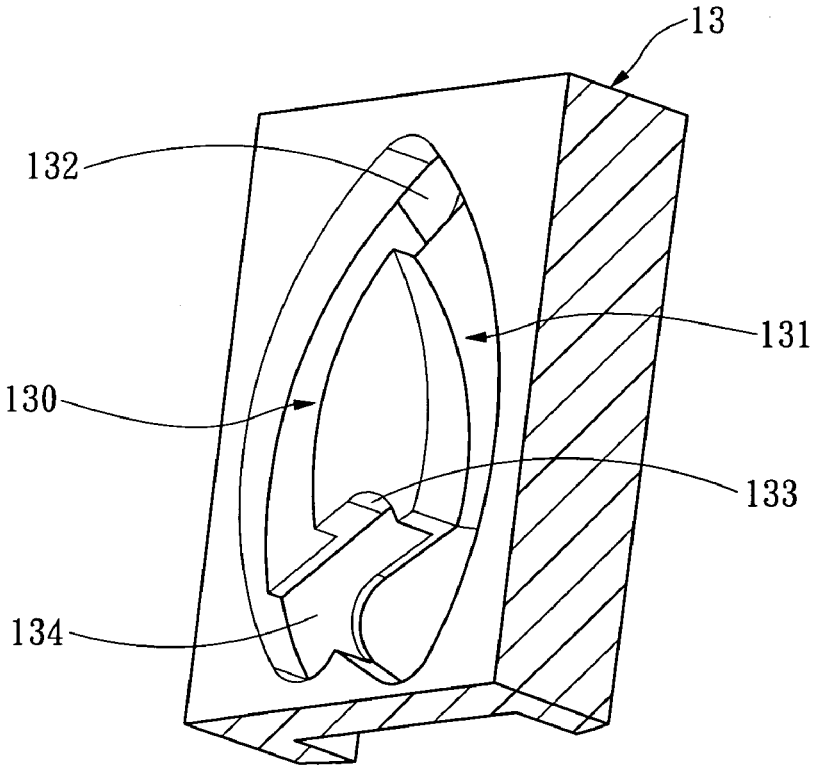
Figure 5A:
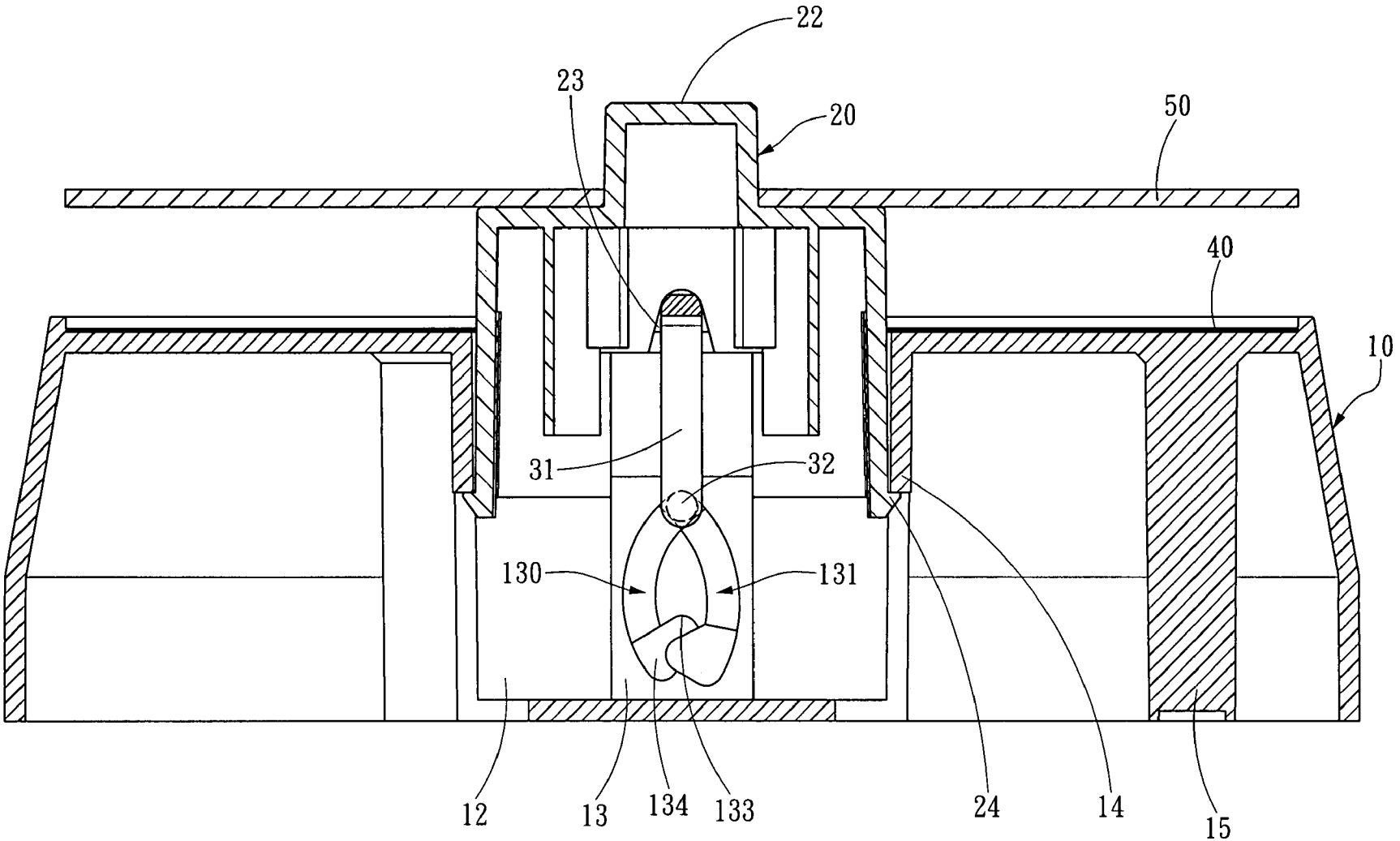
FIGS. 5A through 5F are schematic views of the invention in operating conditions.
Figure 5B:
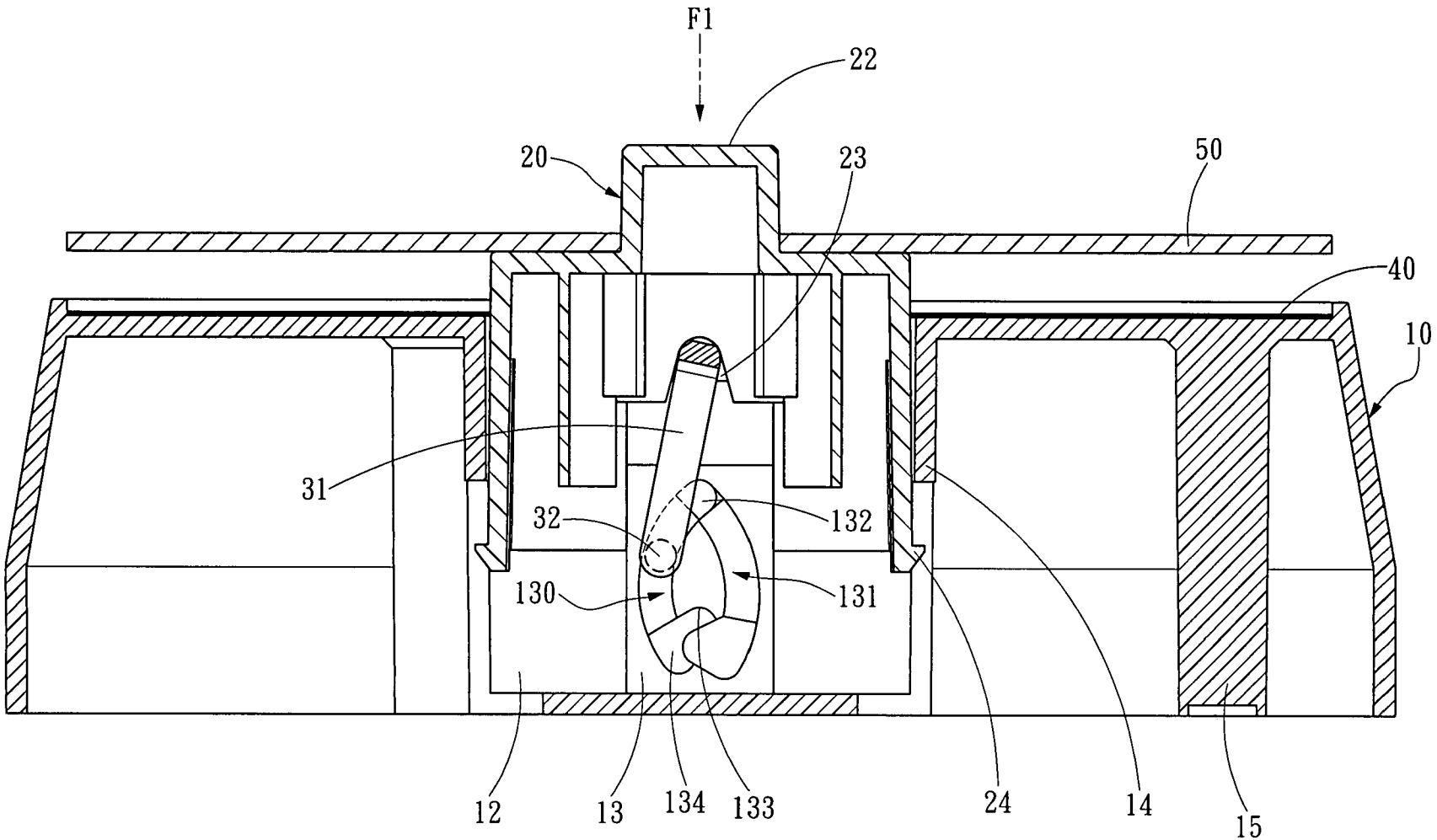
Figure 5C:
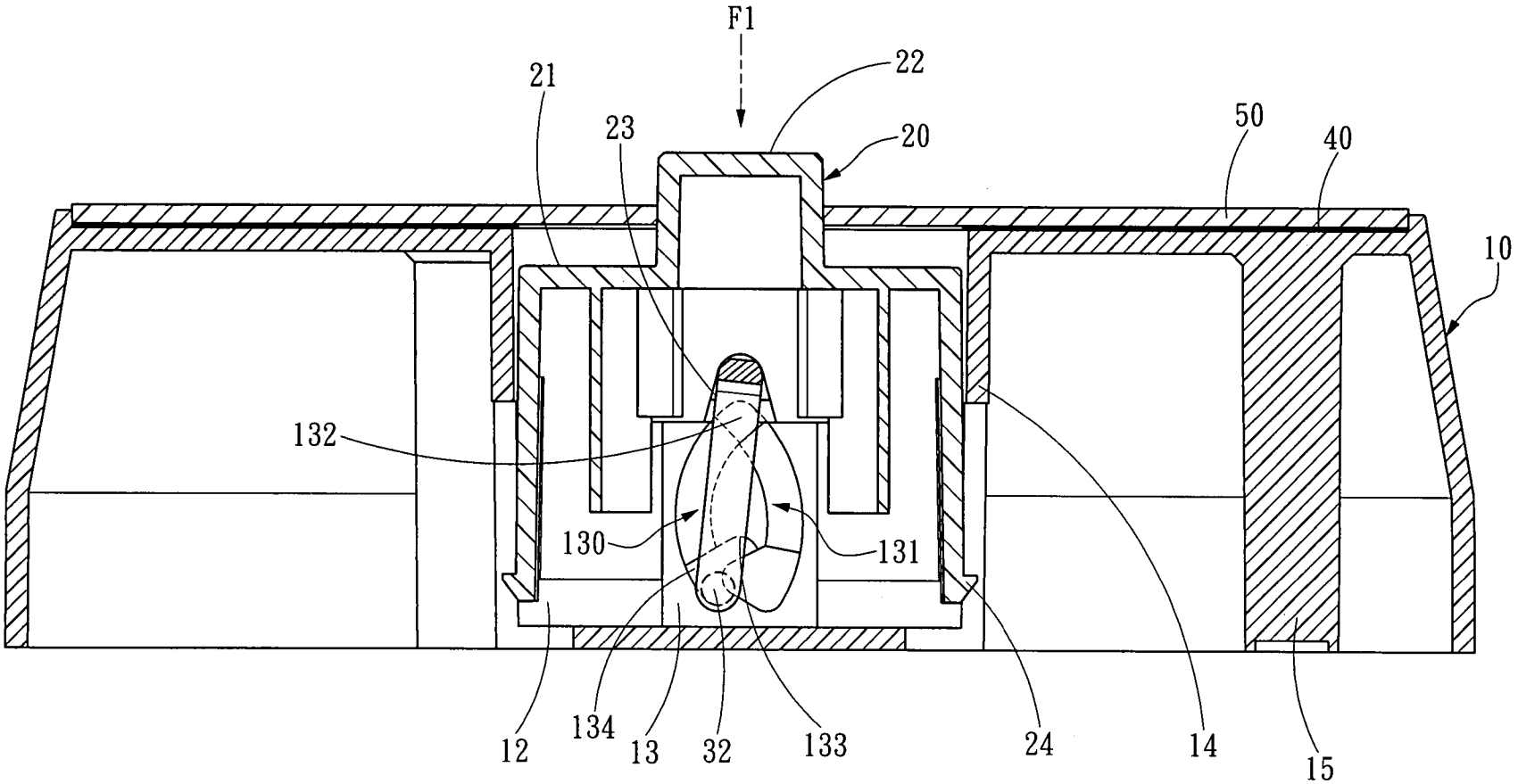
Figure 5D:
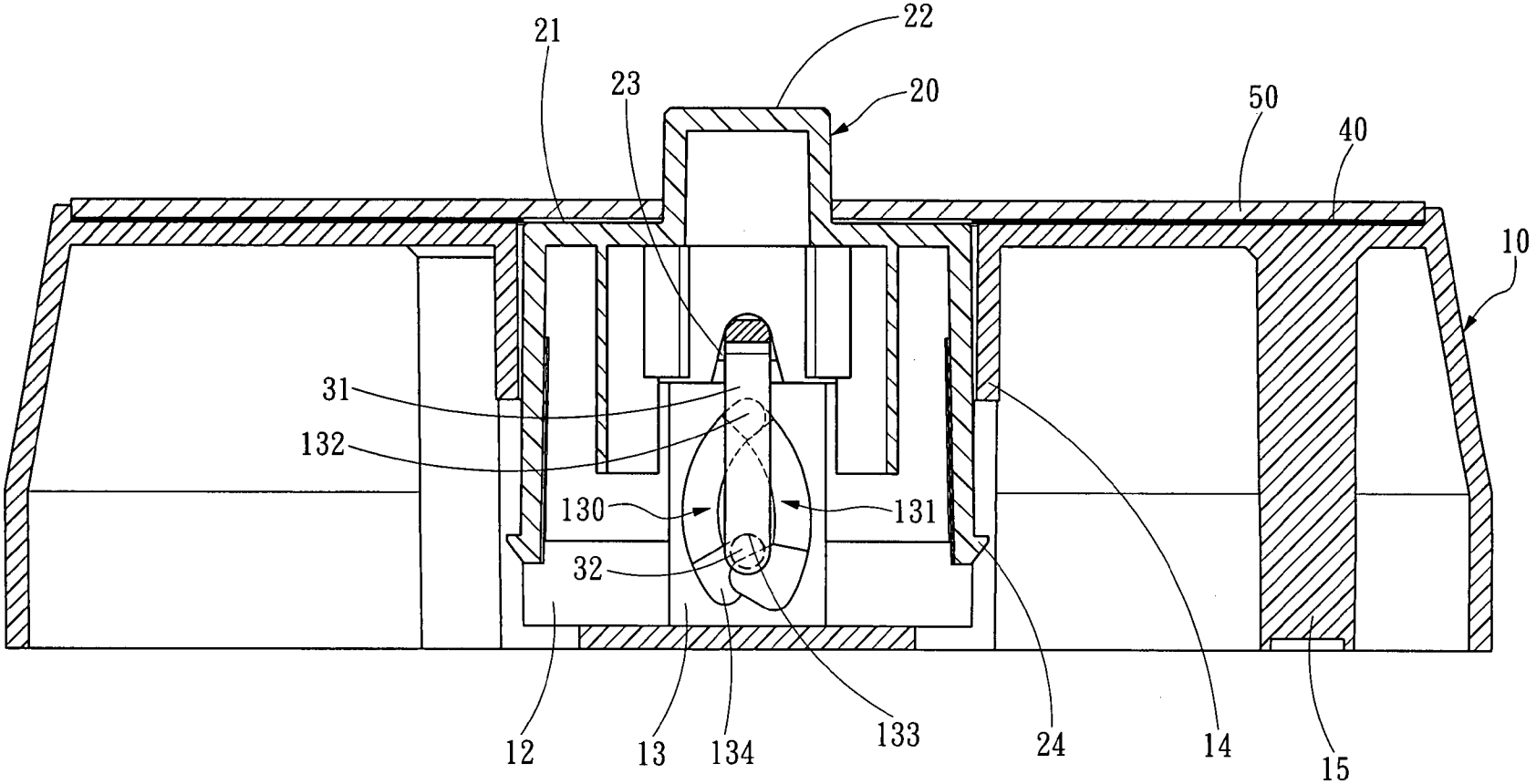
Figure 5E:
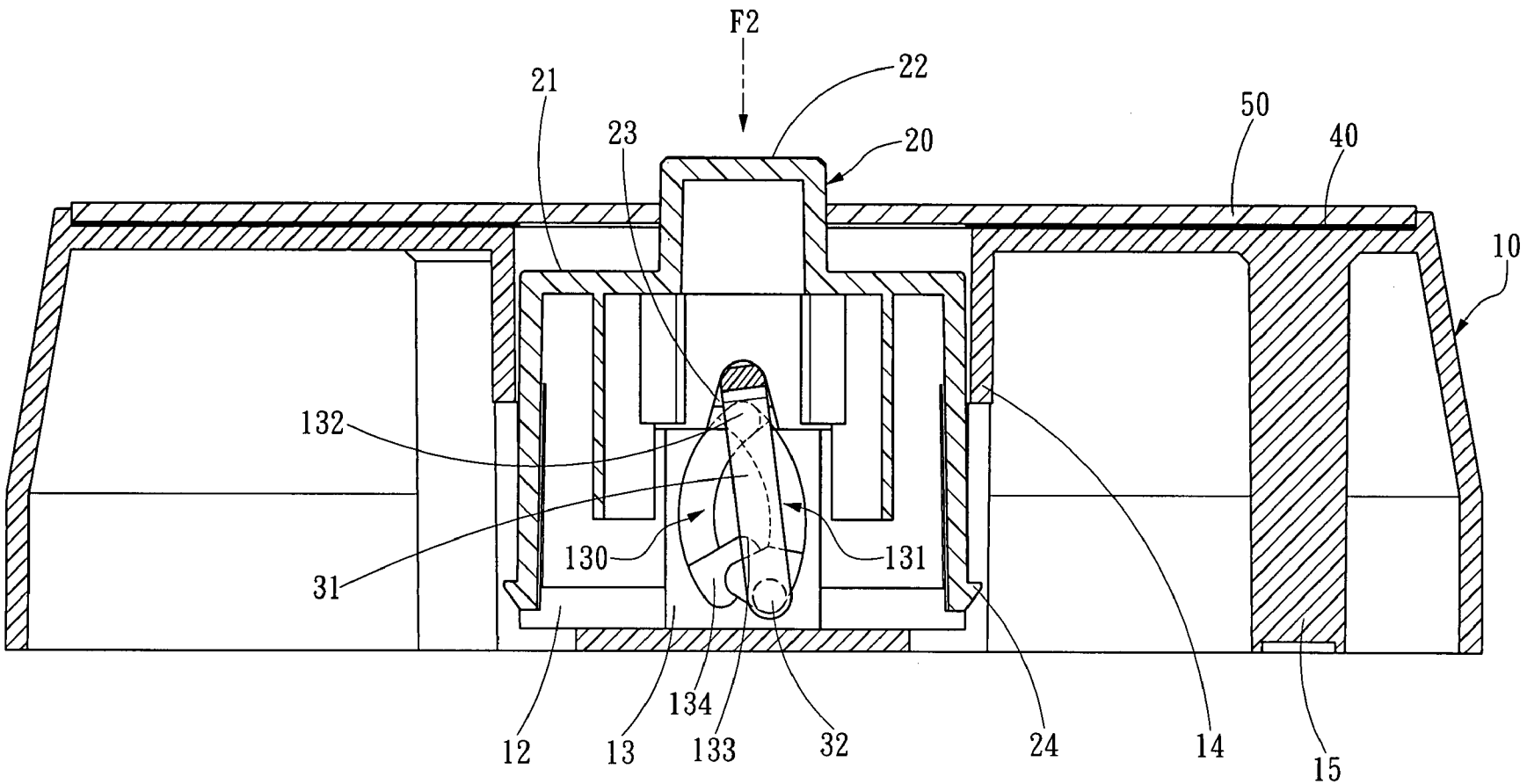
Figure 5F:
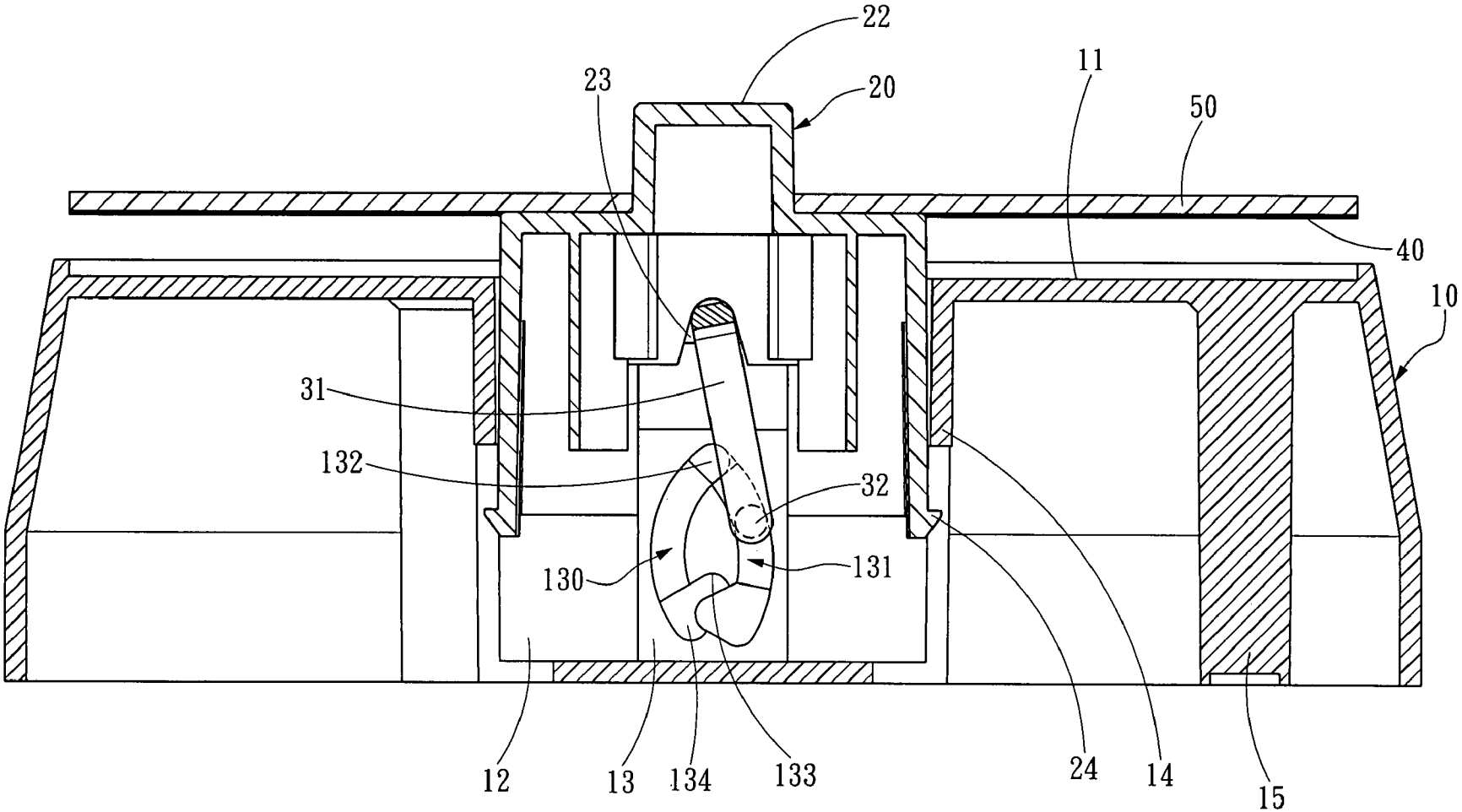

Please referring to FIGS. 1 through 4B, the optical disk labeling device according to the invention includes a label holding dock 10 and an optical disk holding dock 20. The label holding dock 10 has a label holding surface 11 and a plurality of bracing struts 15 at the bottom to support the label holding surface 11, and a holding portion 12 with an opening formed on the label holding surface 11. The holding portion 12 has two track portions 13, and each track portion 13 has a downward track 130 and an upward track 131 that have two ends communicate with each other to form a first anchor portion 132 and a second anchor portion 133. The downward track 130 is formed at a depth gradually decreasing from the first anchor portion 132 to the second anchor portion 133. The downward track 130 also has a release section 134 at the second anchor portion 133. The release section 134 is formed at a depth greater than the depth of the downward track 130 and close to the depth of the second anchor portion 133. The upward track 131 is formed at a depth gradually increasing from the first anchor portion 132 to the second anchor portion 133. The upward track 131 at the second anchor portion 133 is formed at a depth greater than the depth of the release section 134. The optical disk holding dock 20 has a holding strut 22 to run through an optical disk 50 and a disk holding surface 21, and a notch 26 coupled with the tracking portion 13 to be slidably located on the holding portion 12. Through the notch 26 a sliding path of the optical disk holding dock 20 can be confined. The optical disk holding dock 20 further has an actuation member 30 coupling with the holding portion 12. The actuation member 30 and the optical disk holding dock 20 have respectively a coupling strut 33 and a coupling hole 23 engagable with each other. The actuation member 30 has two elastic arms 31 corresponding to the two track portions 13. The two elastic arms 31 have respectively a sliding portion 32 to form respectively an anchor relationship with the first anchor portion 132 and the second anchor portion 133 to maintain the optical disk holding dock 20 at a first position and a second position. The optical disk holding dock 20 and the holding portion 12 further have respectively a latch hook 24 and a detent portion 14 that are latched at the first position of the optical disk holding dock 20 to prevent the optical disk holding dock 20 from escaping the holding portion 12. As shown in the drawings, the first and second anchor portions 132 and 133 and the sliding portion 32 are formed respectively in grooves and a stub corresponding to each other.

Referring to FIGS. 5A through 5F, when the invention is in use, first, place the sliding portion 32 at the first anchor portion 132 to hold the optical disk holding dock 20 at the first position with a label 40 and the optical disk 50 held respectively on the label holding surface 11 and the disk holding surface 21; the optical disk holding dock 20 has a lug 25 formed with bulged traces to hold an inner perimeter of the label 40 to prevent it from moving (referring to FIG. 5A); next, apply a first depressing force F1 on the holding strut 22 to slide the sliding portion 32 on the downward track 130 and drive the optical disk holding dock 20 downwards at the same time and compress the two elastic arms 32 (referring to FIG. 5B) until the sliding portion 32 slides to the release section 134, and the label 40 is bonded to the optical disk 50(referring to FIG. 5C); at that moment the first depressing force F1 is released, and the elastic arms 31 release elastic forces to allow the sliding portion 32 to move upwards and be positioned at the second anchor portion 133, and keep the optical disk holding dock 20 at the second position (referring to FIG. 5D); then apply a second depressing force F2 on the holding strut 22 to release engaging relationship of the sliding portion 32 to allow it to slide upwards until reaching a distal end of the upward track 131 (referring to FIG. 5E); the second depressing force F2 is released and the elastic arms 31 release the elastic forces again to allow the sliding portion 32 to slide on the upward track 131 and drive the optical disk holding dock 20 upwards, and also move the optical disk 50 bonded with the label 40 upwards (referring to FIG. 5F); finally the sliding portion 32 slides to the first anchor portion 132 to form an anchor condition while the optical disk holding dock 20 returns to the first position, and the optical disk 50 can be removed.

Figure 6:
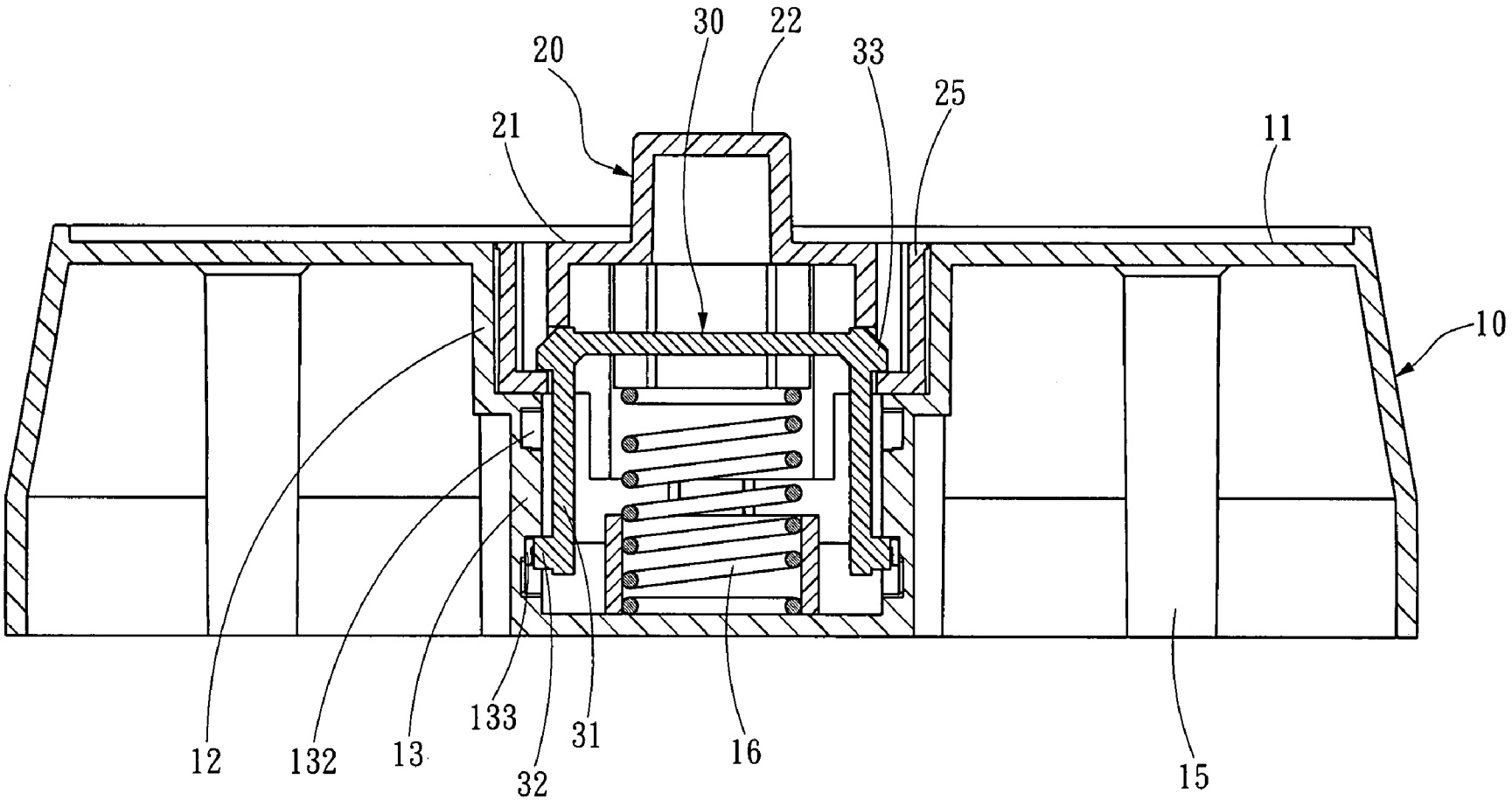
FIG. 6 is a sectional view of another embodiment of the invention.

Refer to FIG. 6, the holding portion 12 may also include a spring 16 with one end pressing the bottom of the holding portion 12 and another end pressing the optical disk holding dock 20 to enhance the elastic forces to aid moving of the optical disk holding dock 20 from the second position to the first position.

As a conclusion, the invention, through the sliding portion 32 of the actuation member 30 and the downward track 130 and upward track 131 that communicate with each other, allows the optical disk holding dock 20 to receive forces to be slid to the first position or second position. Thus the number of elements required is fewer and total structure is simpler. As a result, production cost can be reduced and production efficiency increases. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An optical disk labeling device to bond a label on an optical disk, comprising:

a label holding dock which has a label holding surface and a holding portion formed an opening on the label holding surface, the holding portion having two track portions each having a downward track and an upward track that have two ends formed respectively a first anchor portion and a second anchor portion that communicate with each other; and an optical disk holding dock which is slidably held on the holding portion and coupled therewith through an actuation member, the actuation member having two elastic arms corresponding to the two track portions, and two elastic arms respectively having a sliding portion to form an anchor relationship with the first anchor portion and the second anchor portion to maintain the optical disk holding dock respectively at a first position and a second position;

wherein the optical disk holding dock is depressible by a first depressing force at the first position to allow the sliding portion to slide on the downward track to the second anchor portion to anchor the optical disk holding dock on the second position; the optical disk holding dock on the second position being depressible by a second depressing force to allow the sliding portion to slide on the upward track to the first anchor portion so that the optical disk holding dock returns to the first position.

2. The optical disk labeling device of claim 1, wherein the downward track is formed at a depth gradually decreased from the first anchor portion to the second anchor portion, and the upward track is formed at a depth gradually increased from the first anchor portion to the second anchor portion.

3. The optical disk labeling device of claim 1, wherein the downward track has a release section at the end where the second anchor portion is located, the release section being formed at a depth greater than that of the downward track close to the second anchor portion.

4. The optical disk labeling device of claim 3, wherein the upward track has the end where the second anchor portion is located formed at a depth greater than that of the release section.

5. The optical disk labeling device of claim 1, wherein the first and second anchor portions and the sliding portion are formed respectively in grooves and a stub corresponding to each other.

6. The optical disk labeling device of claim 1, wherein the actuation member and the optical disk holding dock have respectively a coupling strut and a coupling hole engageable with each other.

7. The optical disk labeling device of claim 1, wherein the optical disk holding dock has a notch to be coupled with the track portions to confine a sliding path thereof.

8. The optical disk labeling device of claim 1, wherein the optical disk holding dock and the holding portion have respectively a latch hook and a detent portion that are latchable with each other at the first position.

9. The optical disk labeling device of claim 1, wherein the optical disk holding dock has a lug with bulged traces formed thereon to hold an inner perimeter of the label.

10. The optical disk labeling device of claim 1, wherein the optical disk holding dock has a disk holding surface which has a holding strut to run through the optical disk.

11. The optical disk labeling device of claim 1, wherein the label holding dock has a plurality of bracing struts to support the label holding surface.

12. The optical disk labeling device of claim 1, wherein the holding portion has a spring which has one end pressing the bottom of the holding portion and another end pressing the optical disk holding dock.

* * * * *